US008648543B1

(12) United States Patent
Fan

(10) Patent No.: US 8,648,543 B1
(45) Date of Patent: Feb. 11, 2014

(54) ILLUMINATION DRIVING CIRCUIT

(71) Applicant: Himax Analogic, Inc., Tainan (TW)

(72) Inventor: Hang-Yu Fan, Tainan (TW)

(73) Assignee: Himax Analogic, Inc., Tainan (TW)

( * ) Notice: Subject to any disclaimer, the term of this patent is extended or adjusted under 35 U.S.C. 154(b) by 0 days.

(21) Appl. No.: 13/682,838

(22) Filed: Nov. 21, 2012

(51) Int. Cl.
*H05B 37/02* (2006.01)

(52) U.S. Cl.
CPC ..... *H05B 37/02* (2013.01)
USPC ..... 315/200 R; 315/307; 315/224; 315/209 R

(58) Field of Classification Search
CPC ..... H05B 37/02
USPC ..... 315/200 R, 209 R, 224, 283, 291, 307
See application file for complete search history.

(56) References Cited

U.S. PATENT DOCUMENTS 5,917,312 A * 6/1999 Brkovic ..... 323/282
7,642,762 B2 * 1/2010 Xie et al. ..... 323/282
8,111,014 B2 * 2/2012 Van Erp et al. ..... 315/307
2008/0290819 A1 * 11/2008 Hoepfner et al. ..... 315/306
2012/0104964 A1 * 5/2012 Hughes ..... 315/291
2012/0326618 A1 * 12/2012 Kim ..... 315/224
2013/0026950 A1 * 1/2013 Saes ..... 315/297
2013/0069527 A1 * 3/2013 Underwood et al. ..... 315/51
2013/0162162 A1 * 6/2013 May et al. ..... 315/224

* cited by examiner

*Primary Examiner* — Don Le
(74) *Attorney, Agent, or Firm* — McClure, Qualey & Rodack, LLP

(57) ABSTRACT

An illumination driving circuit for driving a light-emitting load includes a system voltage source, a switch component, an inductor component, an inductor-current sensing module and a control module. The switch component is coupled between the system voltage source and the light-emitting load. The inductor component is connected in series between the system voltage source and the light-emitting load. The inductor-current sensing module includes a sensing resistor component connected in series between the switch component and the inductor component. The control module is configured for controlling the conductive state of the switch component. An inductor-current sensing terminal of the controlling module is coupled to a node between the sensing resistor component and the switch component. The control module calculates an inductor-current through the inductor component according to a voltage level on the inductor-current sensing terminal.

16 Claims, 4 Drawing Sheets

ILLUMINATION DRIVING CIRCUIT

BACKGROUND

1. Technical Field

The present disclosure relates to an illumination device. More particularly, the present disclosure relates to an illumination driving circuit on an illumination device.

2. Description of Related Art

With the rapid development of photoelectric technology in recent years, the industry has developed many kinds of innovative illumination equipments including light-emitting diode (LED) lamps, which are widespread and gather high attentions. Luminous efficiency and durability of the LED lamps are superior to traditional incandescent tubes. In addition, the LED lamps may not cause environmental issues in manufacturing, such that the LED lamps are welcome in the trend of energy saving and environmental protection.

The frequently mentioned advantages of a lighting system composed of LED lamps include high efficiency and long durability. The conversion efficiency and the power factor (PF) are two main factors to achieve the high efficiency on the LED lamps.

Conversion efficiency is referred to how much input power is actually passed to the LED, during the process from the alternating-current (AC) power input to the LED output. The conversion efficiency is higher when a higher proportion of the input power is communicated to the output power.

The power factor is related to the real power and the reactive power within a power signal. The power company provides a three-phased AC power signal with a household voltage ranged from 100V~110V or 200V~240V and an alternating frequency ranged from 50 Hz~60 Hz. In general, an instantaneous consumption power of a resistive load is the product of voltage and current (i.e., P=VI). However, a pure inductive load or a pure capacitive load may cause a phase difference of 90° between current and voltage, and the phase difference will result in a loss of real power. The instantaneous consumption power can be calculated as follows:

$P=VI\cos\theta$, in which I represents the current, V represents the voltage, and θ represents the phase difference between the current and the voltage.

In addition, the power factor can be calculated as follows:

$$PF = \frac{VI\cos\theta}{VI},$$

in which PF represents the power factor, I represents the current, V represents the voltage, and θ represents the phase difference between the current and the voltage.

As shown in the expression above, when the phase difference between current and voltage is 90° (e.g., when the load is a pure inductive load or a pure capacitive load), the power factor will be substantially decreased to zero.

Because LED is not a pure resistive load and the driving circuit for driving LED may bring in the characteristics of inductance and capacitance, it will result in the phase difference between the input voltage and the input current, and also result in the declination of the power factor. In this case, the power company must provide more power output for driving the LED to reach its predetermined output power. The reactive power caused by the phase difference may be converted into unnecessary heat consumption. Therefore, the improvement of the power factor may contribute to reduce the requirement of the output power from the power company, so as to save electricity in practical applications.

Therefore, in order to achieve the goal of energy-saving, it is necessary to develop the LED illumination equipment with high power factor.

SUMMARY

The driving circuit in modern LED illumination system usually utilizes a Buck-based structure, in which the alternating-current (AC) power is rectified firstly and then provided to the driving circuit. The drive circuits for driving LED in practical applications include two groups of designs. One of them is Constant-Voltage type and the other is Constant-Current type. The Constant-Voltage type is relatively simple in circuit structure, but the output of the Constant-Voltage type is tend to be affected by operational characteristics of the LED (for example, when the LED continuously operates for a long time, the impedance of LED will be increased gradually, such that the operational current will be reduced gradually). The stability of the Constant-Voltage type is not good as the Constant-Current type. The disclosure provides a design of the Constant-Current type driving structure.

In order to solve aforesaid problems, the disclosure provides an illumination driving circuit including a Bootstrap-type inductor-current monitoring structure, which can be realized by a Buck-based structure on the high voltage side. The illumination driving circuit includes a sensing resistor component connected in front of the inductor component, and a node between the inductor component and the capacitor component is utilized as a virtual ground terminal of a control module. The control module is configured for detecting the voltage on a node between the sensing resistor component and a switch component, so as to monitor the inductor-current, and further to precisely control the inductor-current going through the inductor component and the following lighting-emitting load.

An aspect of the invention is to provide an illumination driving circuit for driving a light-emitting load. The illumination driving circuit includes a system voltage source, a switch component, an inductor component, an inductor-current sensing module and a control module. The switch component is coupled between the system voltage source and the light-emitting load. The inductor component is connected in series between the switch component and the light-emitting load. The inductor-current sensing module includes a sensing resister component connected in series between the switch component and the inductor component. The control module is coupled to a controlling terminal of the switch component and configured for controlling a conductive state of the switch component. A virtual ground terminal of the control module is coupled to a node between the sensing resister component and the inductor component. An inductor-current sensing terminal of the control module is coupled to a node between the sensing resister component and the switch component. The control module calculates an inductor-current through the inductor component according to a voltage level of the inductor-current sensing terminal.

According to an embodiment of the invention, the system voltage source includes an alternating-current voltage input and a rectifier circuit. The rectifier circuit is coupled between the alternating-current voltage input and the switch component.

According to an embodiment of the invention, the illumination driving circuit further includes an input-voltage sensing module coupled to an input-voltage sensing terminal of the control module. The input-voltage sensing module includes a first voltage-dividing resistor component, a second voltage-dividing resistor component and a capacitor component. The first voltage-dividing resistor component is coupled between the system voltage source and the input-voltage sensing terminal. The second voltage-dividing resistor component is coupled between the virtual ground terminal and the input-voltage sensing terminal. The capacitor component is coupled between the virtual ground terminal and the input-voltage sensing terminal.

According to an embodiment of the invention, the input-voltage sensing module is configured for sensing an input-voltage from the system voltage source and transmitting the input-voltage to the input-voltage sensing terminal of the control module, and accordingly the control module synchronizes a phase of the inductor-current to the input-voltage.

According to an embodiment of the invention, the inductor-current sequentially goes through the switch component, the sensing resistor component, the inductor component and the light-emitting load.

According to an embodiment of the invention, the control module senses the inductor-current according to a resistance of the sensing resistor component and a voltage difference between the inductor-current sensing terminal and the virtual ground terminal.

According to an embodiment of the invention, the illumination driving circuit further includes a voltage activation module coupled to an activation sensing terminal of the control module. The voltage activation module includes a resistor component, a diode and a capacitor component. The resistor component is coupled between the system voltage source and the activation sensing terminal. The diode is coupled between the light-emitting load and the activation sensing terminal. The capacitor component is coupled between the virtual ground terminal and the activation sensing terminal.

According to an embodiment of the invention, when the switch component is turned off initially, the input-voltage of the system voltage source charges the capacitor via the resistor component of the voltage activation module, such that a voltage level of the activation sensing terminal is elevated until the voltage level of the activation sensing terminal reaches a activation threshold voltage of the control module, and then the control module turns on the switch component.

According to an embodiment of the invention, the illumination driving circuit further includes an output capacitor component shunt connected with the light-emitting load. After the switch component is turned on, the input-voltage of the system voltage source is configured for accumulating energy in the inductor component and the output capacitor component via the switch component until the voltage level of the inductor-current sensing terminal reaches a lockout threshold voltage of the control module, and then the control module turns off the switch component.

According to an embodiment of the invention, after the control module turns off the switch component, the inductor component releases energy to the light-emitting load and generates the inductor-current. The control module monitors the inductor-current by the voltage level of the inductor-current sensing terminal. The control module turns on the switch component again when the inductor-current is less than an inductor threshold current.

BRIEF DESCRIPTION OF THE DRAWINGS

The disclosure can be more fully understood by reading the following detailed description of the embodiments, with reference to the accompanying drawings as follows.

DESCRIPTION OF THE EMBODIMENTS

In the following description, several specific details are presented to provide a thorough understanding of the embodiments of the present invention. One skilled in the relevant art will recognize, however, that the present invention can be practiced without one or more of the specific details, or in combination with or with other components, etc. In other instances, well-known implementations or operations are not shown or described in detail to avoid obscuring aspects of various embodiments of the present invention.

Figure 1:
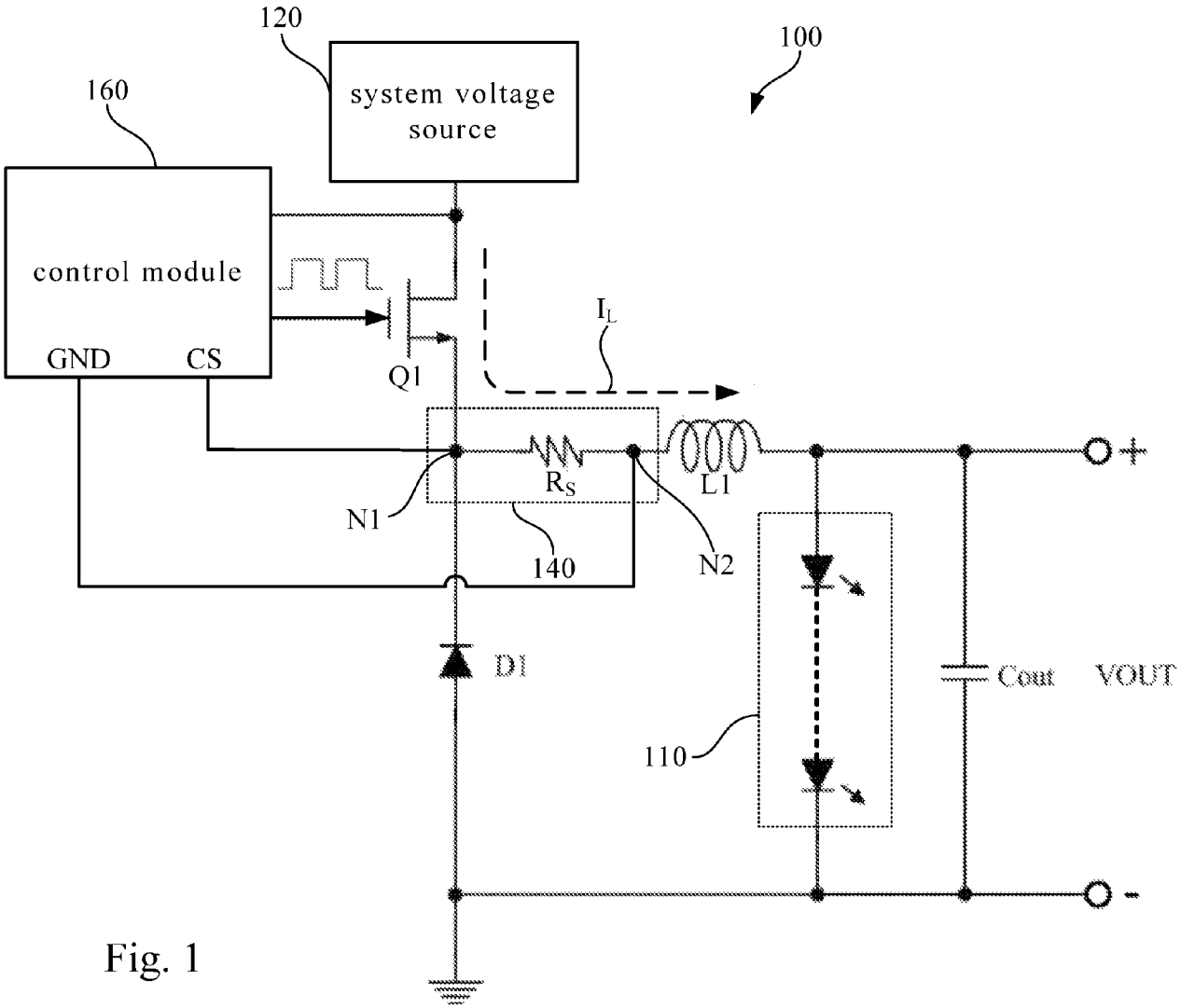
FIG. 1 is a schematic diagram illustrating an illumination driving circuit according to an embodiment of the invention.

Reference is made to FIG. 1, which is a schematic diagram illustrating an illumination driving circuit 100 according to an embodiment of the invention. The illumination driving circuit 100 is used for driving a light-emitting load 110. In the embodiment, the light-emitting load 110 can be a light-emitting diode load, or any other equivalent light-emitting load which is not purely resistive.

The illumination driving circuit 100 includes a system voltage source 120, a switch component Q1, an inductor component L1, an inductor-current sensing module 140 and a control module 160.

An input terminal and an output terminal of the switch component Q1 are coupled between the system voltage source L1 and the light-emitting load 110. In the embodiment, the switch component Q1 can be a semiconductor switch. The control module 160 is coupled to a controlling terminal (e.g., a gate electrode of the semiconductor switch) of the switch component Q1 for controlling a conductive state of the switch component Q1.

The inductor component L1 is connected in series between the switch component Q1 and the light-emitting load 110.

In the embodiment, the illumination driving circuit 100 includes the inductor-current sensing module 140, which is mainly used for directly or indirectly sensing an inductor-current $I_L$ going through inductor component L1. As shown in FIG. 1, the inductor-current sensing module 140 includes a sensing resister component $R_S$ connected in series between the switch component Q1 and the inductor component L1.

An inductor-current sensing terminal CS of the control module 160 is coupled to a first node N1 between the sensing resister component $R_S$ and the switch component Q1. A virtual ground terminal GND of the control module 160 is coupled to a second node N2 between the sensing resister component $R_S$ and the inductor component L1. Aforesaid connection is disclosed as the Bootstrap-type inductor-current monitoring structure mentioned in this disclosure.

The control module may acknowledge the voltage difference between the voltage levels on the inductor-current sensing terminal CS (i.e., the voltage on the first node N1) and the virtual ground terminal GND (i.e., the voltage on the second node N2). Because the resistive value of the sensing resister component $R_S$ is fixed and already known in the design stage, the control module may calculates the inductor-current $I_L$ going through inductor component L1 according the voltage difference between the nodes N1 and N2. In the embodiment, the voltage level on the second node N2 (between the sensing resister component $R_S$ and the inductor component L1) is utilized as the ground level adopted by the control module 160. In other word, the control module 160 may acknowledge the inductor-current $I_L$ going through inductor component L1 by detecting the voltage level on the inductor-current sensing terminal CS. In addition, the inductor-current $I_L$ in the embodiment sequentially goes through the switch component Q1, the sensing resistor component $R_S$, the inductor component L1 and the light-emitting load 110. Therefore, the control module 160 may acknowledge the operational current over the light-emitting load 110 by sensing the inductor-current $I_L$. In practical applications, the illumination driving circuit 100 may further include other components.

Figure 2:
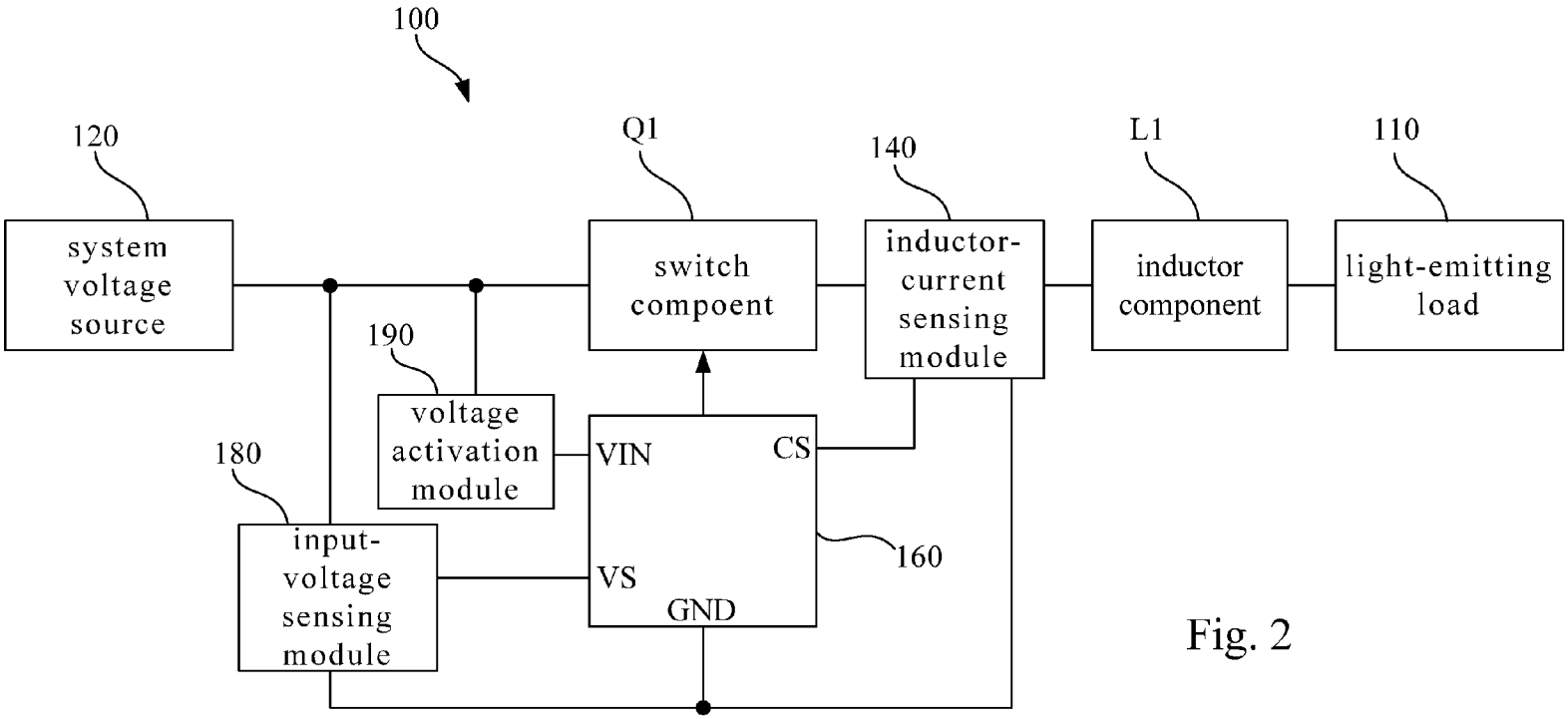
FIG. 2 is a functional block diagram illustrating an illumination driving circuit according an embodiment of the invention.
Figure 3:
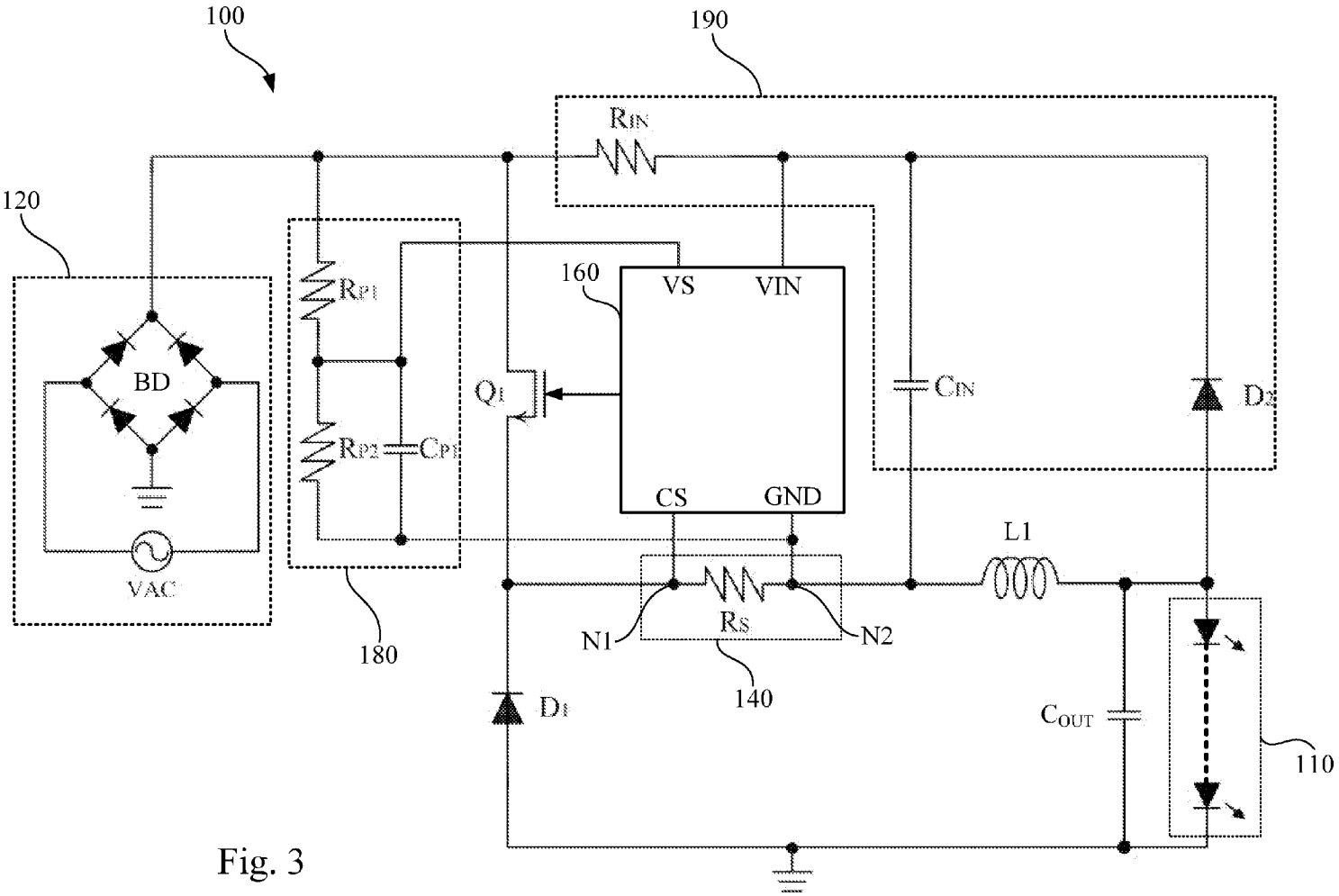
FIG. 3 illustrates an embodiment of circuit structure of the illumination driving circuit in the invention.

Reference is made to FIG. 2 and FIG. 3. FIG. 2 is a functional block diagram illustrating an illumination driving circuit 100 according an embodiment of the invention. FIG. 3 illustrates an embodiment of circuit structure of the illumination driving circuit 100, but the invention is not limited to the circuit structure shown in FIG. 3.

As the embodiment shown in FIG. 2, the illumination driving circuit 100 further includes an input-voltage sensing module 180 and a voltage activation module 190. The input-voltage sensing module 180 and the voltage activation module 190 are electrically connected to an input node between the system voltage source 120 and the switch component Q1, for sensing an input signal generated from the system voltage source 120. As shown in FIG. 3, the illumination driving circuit 100 further includes an output capacitor component $C_{OUT}$, which is shunt connected with the light-emitting load 110.

As shown in FIG. 3, the system voltage source 120 includes an alternating-current voltage input VAC and a rectifier circuit (i.e., the bridge rectifier BD in this embodiment). The bridge rectifier BD is coupled between the alternating-current voltage input VAC and the switch component Q1. In some embodiments, the alternating-current voltage input VAC can be an external household-electricity outlet.

The input-voltage sensing module 180 is coupled to an input-voltage sensing terminal VS of the control module 160. As shown in FIG. 3, the input-voltage sensing module 180 includes a first voltage-dividing resistor component $R_{P1}$, a second voltage-dividing resistor component $R_{P2}$ and a capacitor component $C_{P1}$. The first voltage-dividing resistor component $R_{P1}$ is coupled between the system voltage source 120 and the input-voltage sensing terminal VS. The second voltage-dividing resistor component $R_{P2}$ is coupled between the virtual ground terminal GND and the input-voltage sensing terminal VS. The capacitor component $C_{P1}$ is coupled between the virtual ground terminal GND and the input-voltage sensing terminal VS.

The input-voltage sensing module 180 is configured for sensing an input-voltage from the system voltage source 120 and transmitting the input-voltage to the input-voltage sensing terminal VS of the control module 160. According to the voltage level on the input-voltage sensing terminal VS (representing the input voltage from the system voltage source 120) and the voltage level on the inductor-current sensing terminal CS (representing the input current from the system voltage source 120), the control module 160 acknowledge the relationship between the input voltage and current from the system voltage source 120. The control module 160 is configured to adjust the conductive state (e.g., a conductive frequency, a conductive band or a conductive phase) of the switch component Q1 according to aforesaid relationship, so as to synchronize a phase of the inductor-current to the input-voltage according to the voltage level on the input-voltage sensing terminal VS. The control module 160 synchronizes a phase of the inductor-current $I_L$ to the input-voltage.

Figure 4:
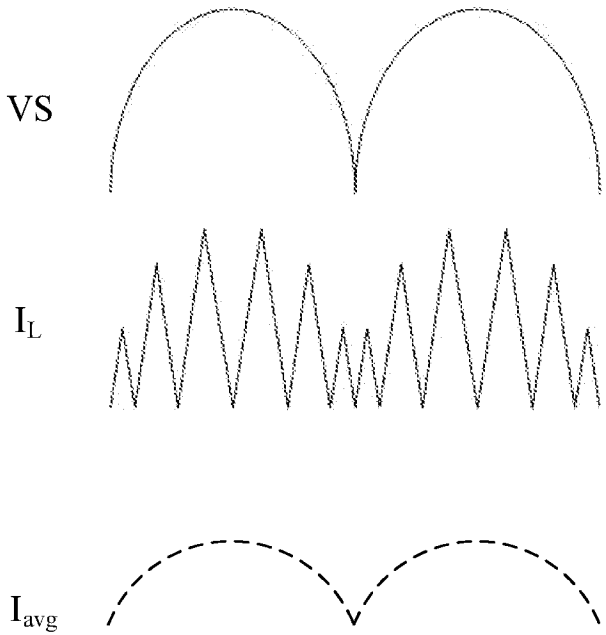
FIG. 4 is a timing diagram illustrating signals of the illumination driving circuit according to an embodiment of the invention.

Reference is also made to FIG. 4, which is a timing diagram illustrating signals of the illumination driving circuit 100. As shown in FIG. 4, the waveform on top is the voltage level on the input-voltage sensing terminal VS (i.e., the input voltage from the system voltage source 120 after rectified by the bridge rectifier BD). The control module 160 adjusts the conductive state of the switch component Q1 for synchronizing the phase of the inductor-current $I_L$ to the input-voltage (referring the waveform VS in FIG. 4).

In addition, the voltage activation module 190 of the illumination driving circuit 100 shown in FIG. 3 is coupled to an activation sensing terminal VIN of the control module 160. The voltage activation module 190 includes a resistor component $R_{IN}$, a diode $D_2$ and a capacitor component $C_{IN}$. The resistor component $R_{IN}$ is coupled between the system voltage source 120 and the activation sensing terminal VIN. The diode $D_2$ is coupled between the light-emitting load 110 and the activation sensing terminal VIN. The capacitor component $C_{IN}$ is coupled between the virtual ground terminal GND and the activation sensing terminal VIN. The voltage activation module 190 is configured for driving the control module 160 from an initial start-up state into a proper working state.

Following paragraphs provide an operational example for demonstrating the behavior of the illumination driving circuit 100 of the disclosure, but the invention is not limited thereto.

At the initial start-up state (e.g., the light-emitting load is not lighted), the switch component is turned off at the initial stage. The system voltage source 120 is enabled to provide the input-voltage. The input-voltage of the system voltage source 120 charges the capacitor $C_{IN}$ via the resistor component $R_{IN}$ of the voltage activation module 190, such that a voltage level of the activation sensing terminal VIN is elevated until the voltage level of the activation sensing terminal VIN reaches a activation threshold voltage of the control module 160. When the voltage level of the activation sensing terminal VIN reaches the activation threshold voltage, the control module 160 turns on the switch component Q1, so as to complete the initial activation of the illumination driving circuit 100.

After the switch component Q1 is turned on, the input-voltage of the system voltage source 120 is configured for accumulating energy in the inductor component L1 and the output capacitor component $C_{OUT}$ via the switch component Q1, such that the voltage level of the inductor-current sensing terminal CS is elevated gradually, until the voltage level of the inductor-current sensing terminal CS reaches a lockout threshold voltage of the control module 160. When the voltage level of the inductor-current sensing terminal CS reaches the lockout threshold voltage, the control module 160 turns off the switch component Q1.

After the control module 160 turns off the switch component Q1, the inductor component L1 releases energy to the light-emitting load 110 and generates the inductor-current $I_L$. The control module 160 monitors the inductor-current $I_L$ by the voltage level of the inductor-current sensing terminal CS (i.e., the voltage level of the first node N1 between the sensing resistor component $R_S$ and the switch component Q1). The voltage sensing module 180 may further provide its obtained voltage level (representing the input voltage) to the input-voltage sensing terminal VS of the control module 160, such that the control module 160 may synchronize the phases between the inductor-current $I_L$ and the input-voltage (as shown in FIG. 4).

When the inductor-current $I_L$ is less than an inductor threshold current (e.g., when the voltage level on the inductor-current sensing terminal CS is lower than a threshold voltage value), the control module 160 turns on the switch component Q1 again. Based on aforesaid cyclic operation, a stable driving signal is provided to the light-emitting load 110. The average current (referring to the average current waveform lavg in FIG. 4) through the light-emitting load 110 is approximately a positive-level sine waveform.

Based on aforesaid embodiments, the disclosure provides an illumination driving circuit including a Bootstrap-type inductor-current monitoring structure, which can be realized by a Buck-based structure on the high voltage side. The illumination driving circuit includes a sensing resistor component connected in front of the inductor component, and a node between the inductor component and the capacitor component is utilized as a virtual ground terminal of a control module. The control module is configured for detecting the voltage on a node between the sensing resistor component and a switch component, so as to monitor the inductor-current, and further to precisely control the inductor-current going through the inductor component and the following lighting-emitting load.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded with the broadest interpretation so as to encompass all such modifications and similar structures.

What is claimed is:

1. An illumination driving circuit for driving a light-emitting load, the illumination driving circuit comprising:

a system voltage source;

a switch component coupled between the system voltage source and the light-emitting load;

an inductor component connected in series between the switch component and the light-emitting load;

an inductor-current sensing module comprising a sensing resister component connected in series between the switch component and the inductor component; and a control module coupled to a controlling terminal of the switch component and configured for controlling a conductive state of the switch component, a virtual ground terminal of the control module being coupled between the sensing resister component and the inductor component, an inductor-current sensing terminal of the control module being coupled between the sensing resister component and the switch component, the control module calculating an inductor-current through the inductor component according to a voltage level of the inductor-current sensing terminal.

2. The illumination driving circuit of claim 1, wherein the system voltage source comprises:

an alternating-current voltage input; and a rectifier circuit coupled between the alternating-current voltage input and the switch component.

3. The illumination driving circuit of claim 1, wherein the illumination driving circuit further comprises an input-voltage sensing module coupled to an input-voltage sensing terminal of the control module, the input-voltage sensing module comprises:

a first voltage-dividing resistor component coupled between the system voltage source and the input-voltage sensing terminal;

a second voltage-dividing resistor component coupled between the virtual ground terminal and the input-voltage sensing terminal; and a capacitor component coupled between the virtual ground terminal and the input-voltage sensing terminal.

4. The illumination driving circuit of claim 3, wherein the input-voltage sensing module is configured for sensing an input-voltage from the system voltage source and transmitting the input-voltage to the input-voltage sensing terminal of the control module, and accordingly the control module synchronizes a phase of the inductor-current to the input-voltage.

5. The illumination driving circuit of claim 1, wherein the inductor-current sequentially goes through the switch component, the sensing resistor component, the inductor component and the light-emitting load.

6. The illumination driving circuit of claim 5, wherein the control module senses the inductor-current according to a resistance of the sensing resistor component and a voltage difference between the inductor-current sensing terminal and the virtual ground terminal.

7. The illumination driving circuit of claim 1, wherein the illumination driving circuit further comprises a voltage activation module coupled to an activation sensing terminal of the control module, the voltage activation module comprises:

a resistor component coupled between the system voltage source and the activation sensing terminal;

a diode coupled between the light-emitting load and the activation sensing terminal; and a capacitor component coupled between the virtual ground terminal and the activation sensing terminal.

8. The illumination driving circuit of claim 7, wherein, when the switch component is turned off initially, the input-voltage of the system voltage source charges the capacitor via the resistor component of the voltage activation module, such that a voltage level of the activation sensing terminal is elevated until the voltage level of the activation sensing terminal reaches a activation threshold voltage of the control module, and then the control module turns on the switch component.

9. The illumination driving circuit of claim 8, wherein the illumination driving circuit further comprises an output capacitor component shunt connected with the light-emitting load, after the switch component is turned on, the input-voltage of the system voltage source is configured for accumulating energy in the inductor component and the output capacitor component via the switch component until the voltage level of the inductor-current sensing terminal reaches a lockout threshold voltage of the control module, and then the control module turns off the switch component.

10. The illumination driving circuit of claim 9, wherein after the control module turns off the switch component, the inductor component releases energy to the light-emitting load and generates the inductor-current, the control module monitors the inductor-current by the voltage level of the inductor-current sensing terminal, the control module turns on the switch component again when the inductor-current is less than an inductor threshold current.

11. An illumination driving method, suitable on a illumination driving circuit for driving a light-emitting load, the illumination driving circuit comprising a system voltage source, a switch component, an inductor component, an inductor-current sensing module and a control module, a virtual ground terminal of the control module being coupled between a sensing resister component of the inductor-current sensing module and the inductor component, an inductor-current sensing terminal of the control module being coupled between the sensing resister component and the switch component, the illumination driving method comprising:

calculating an inductor-current through the inductor component according to a voltage level of the inductor-current sensing terminal; and controlling a conductive state of the switch component according to the inductor-current.

12. The illumination driving method of claim 11, further including:

sensing an input-voltage from the system voltage source; and transmitting the input-voltage to an input-voltage sensing terminal of the control module; and synchronizing a phase of the inductor-current to the input-voltage according to the input-voltage.

13. The illumination driving method of claim 11, further including:

senses the inductor-current according to a resistance of the sensing resistor component and a voltage difference between the inductor-current sensing terminal and the virtual ground terminal.

14. The illumination driving method of claim 11, wherein the illumination driving circuit further comprises a voltage activation module coupled to an activation sensing terminal of the control module, the voltage activation module comprises a resistor component, a diode and a capacitor component, the illumination driving method further includes:

when the switch component is turned off initially, charging the capacitor via the resistor component of the voltage activation module; and elevating a voltage level of the activation sensing terminal until the voltage level of the activation sensing terminal reaches a activation threshold voltage of the control module; and turning on the switch component when the voltage level of the activation sensing terminal reaches a activation threshold voltage of the control module.

15. The illumination driving method of claim 14, wherein the illumination driving circuit further comprises an output capacitor component, the illumination driving method further includes:

after the switch component is turned on, accumulating energy in the inductor component and the output capacitor component via the switch component until the voltage level of the inductor-current sensing terminal reaches a lockout threshold voltage of the control module; and turning off the switch component when the voltage level of the inductor-current sensing terminal reaches a lockout threshold voltage of the control module.

16. The illumination driving method of claim 15, wherein the illumination driving method further includes:

after the switch component is turned off, releasing energy from the inductor component to the light-emitting load, so as generate the inductor-current;

monitoring the inductor-current by the voltage level of the inductor-current sensing terminal;

turning on the switch component again when the inductor-current is less than an inductor threshold current.

* * * * *